United States Patent [19]

Hurwitz

[11] 3,937,298

[45] Feb. 10, 1976

[54] LEVELLING ATTACHMENT FOR LADDERS

[76] Inventor: Mathew Hurwitz, 63 Oakland Ave., Auburndale, Mass. 02166

[22] Filed: Apr. 16, 1975

[21] Appl. No.: 568,552

[52] U.S. Cl. ..... 182/200; 182/204

[51] Int. Cl.[2] ..... E06C 7/44

[58] Field of Search ..... 182/202, 201, 200, 204, 182/205; 248/226 R, 221, 245, 223, 188.8, 188.2; 403/390, 394, 398, 400

[56] References Cited

UNITED STATES PATENTS

| | | | |
|---|---|---|---|
| 792,065 | 6/1905 | Myers | 403/394 |
| 2,327,317 | 8/1943 | Randall | 182/200 |
| 3,356,395 | 12/1967 | Dygert | 248/245 |

*Primary Examiner*—Reinaldo P. Machado
*Attorney, Agent, or Firm*—Arnstein, Gluck, Weitzenfeld & Minow

[57] ABSTRACT

An attachment for extension ladders which accommodates to uneven terrain and supports the ladder against leaning or tipping laterally. The attachment includes a pair of open ended sockets mounted at opposite ends of a transverse member which is attached to the rails of an extension ladder. Two independently adjustable legs are slidably received, each in a respective socket outboard of the rails. A latching element associated with each socket locks each leg in a position of adjustment.

2 Claims, 10 Drawing Figures

LEVELLING ATTACHMENT FOR LADDERS

BACKGROUND OF THE INVENTION

The present invention relates to an attachment for an extension ladder to permit the ladder to stand in a safe upstanding position on uneven terrain or supporting surfaces. Additionally, the attachment presents an extended bearing surface to support the ladder against leaning or tipping laterally.

SUMMARY OF THE INVENTION

The present invention provides a levelling attachment for extension ladders which may be readily and securely locked in a position of adjustment. In particular, the present invention provides the user with an inexpensive device which he may purchase as an accessory and easily attach to any common extension ladder, without damaging or weakening the ladder.

Accordingly, it is an object of the present invention to provide an attachment for ladders having adjustable leg means for accommodating a ladder to uneven terrain.

Another object of this invention is the provision of means for mounting the attachment to a ladder so that it will not weaken or place undue stress on the ladder.

A further object of this invention is the provision of a levelling attachment for ladders which prevents undue stress from being transmitted to the ladder when the accessory is in use.

Other and further objects and advantages of the present invention will become apparent from the following description when considered in connection with the accompanying drawings.

BRIEF DESCRIPTION OF A PREFERRED EMBODIMENT

Figure 1:
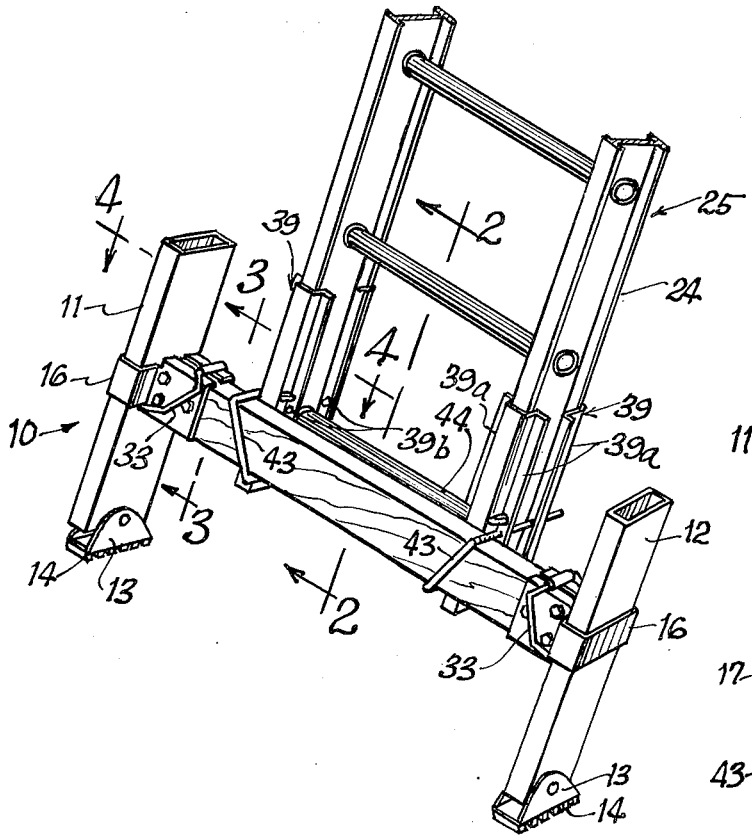
FIG. 1 is a perspective view showing my invention attached to the side rails of an extension ladder.
Figure 7:
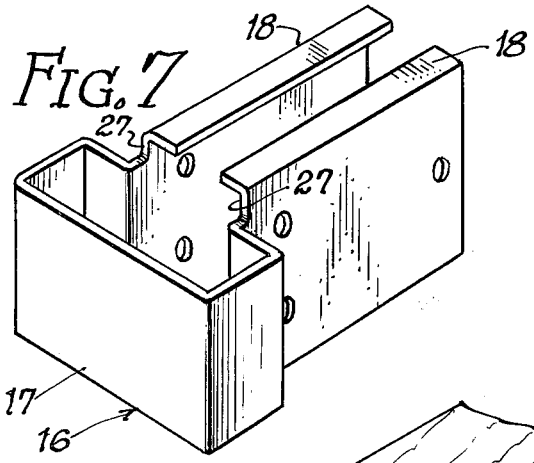
FIGS. 7–10 are perspective views showing components of the detail assembly illustrated in FIG. 6.

Referring particularly to FIG. 1, the attachment of my invention, indicated generally by the numeral 10, comprises a pair of legs 11 and 12 formed preferably of sections of rectangular tubing. A foot member 13 is pivotally connected to the lower portion of each leg and is provided with a corrugated rubber pad 14 to engage the ground. A pair of knuckles 16 constructed of sheet metal, substantially as illustrated in FIG. 7, are arranged to receive legs 11 or 12. Each knuckle 16 includes a generally open ended socket section 17 having internal dimensions such as to freely receive a leg 11 or 12 for sliding movement. Thus, each leg 11 or 12 may slide vertically freely within the socket section 17 and by virtue of the rectangular cross-section is prevented from twisting relative to the knuckle 16.

Each knuckle 16 includes a pair of channel ears 18 integral with the socket section 17 and arranged in confronting relation to each other, each pair of ears 18 providing a socket to receive one end of a transverse member 19 which preferably may be formed of wood and is rectangular in cross section. The transverse member 19 is sized to withstand the bending and torsional stresses which would otherwise be transmitted by the legs 11 and 12 to the side rails 24 of a ladder 25. As seen clearly in FIG. 6, the vertical dimension of the channel ears 18 is somewhat greater than that of the open ended socket section 17 thus forming shoulders 27 in each of the channel ears 18 for a purpose as will be hereinafter described.

Figure 6:
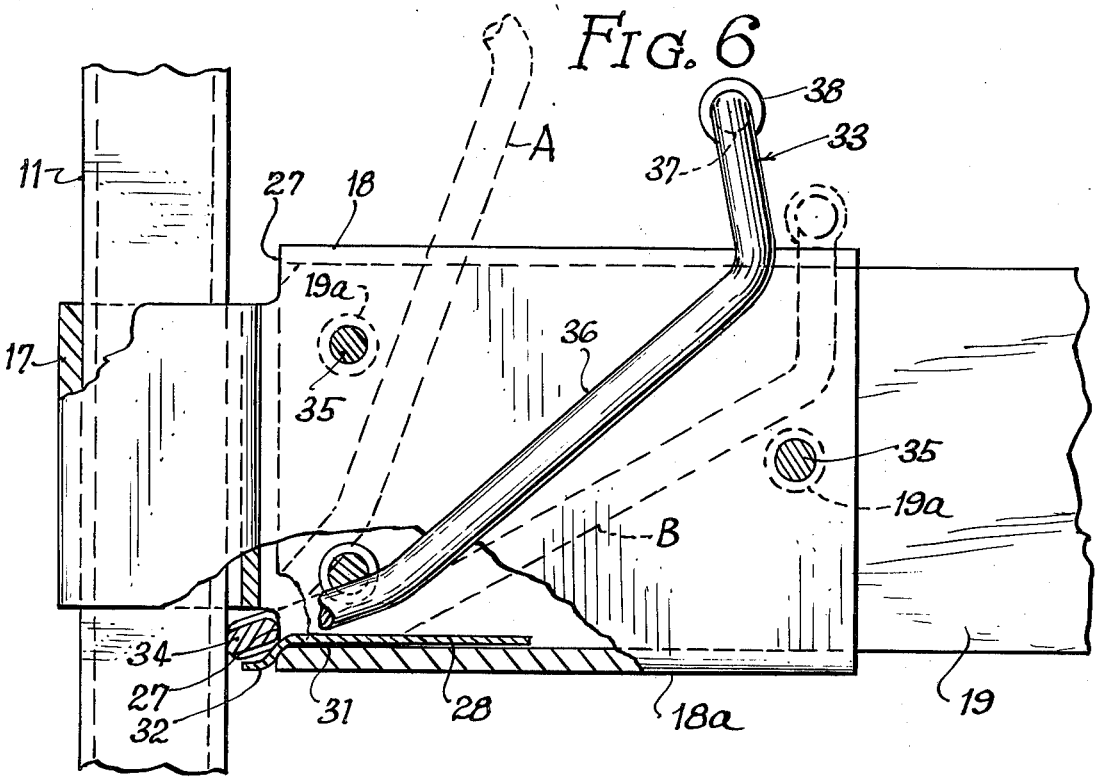
FIG. 6 is an elevational view, on an enlarged scale and partly in cross-section, of a detail assembly.
Figure 8:
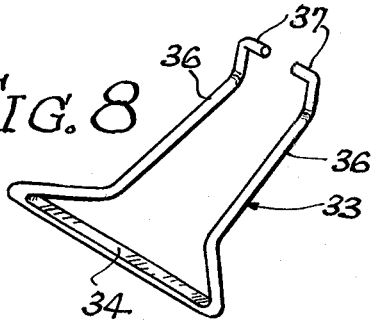
Figure 9:
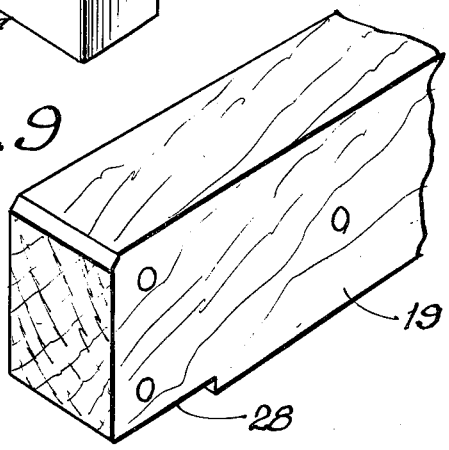
Figure 10:
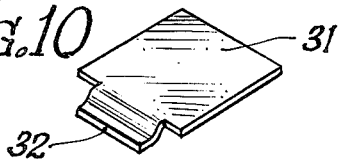

The transverse member 19 is recessed on its under surface at each end, as at 28, sufficient to receive a flat latch retaining member 31 (FIG. 10) preferably formed of steel and held in assembled relation by the lower flanges 18*a* of the pair of channel ears 18. The member 31 is provided with an offset lip 32 which retains the latch member 33, presently to be described, in assembled relation, as seen in FIG. 6. The latch member 33 is shaped substantially as illustrated in FIG. 8 and includes a flattened bight portion 34 integrally connected to side arms 36 which terminate in inwardly bent portions 37 which are received in a tubular section 38 providing a handle for manually rotating the latch member 33, as will be hereinafter explained. The transverse member 19 is provided with holes in which are received spacer sleeves 19*a*. Said sleeves 19*a* are in registration with holes in the channel ears 18, and bolts 35 are passed through said holes and sleeves to secure the parts together. The sleeves 19*a* prevent crushing of the transverse members 19 and binding of the socket section 17 on legs 11 and 12.

Figure 2:
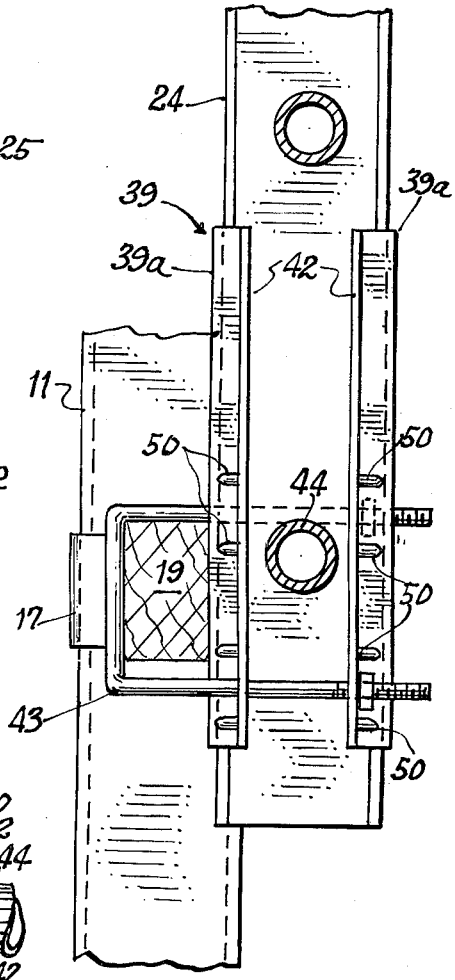
FIG. 2 is a cross-sectional view, on an enlarged scale, taken substantially on line 2—2 of FIG. 1.
Figure 4:
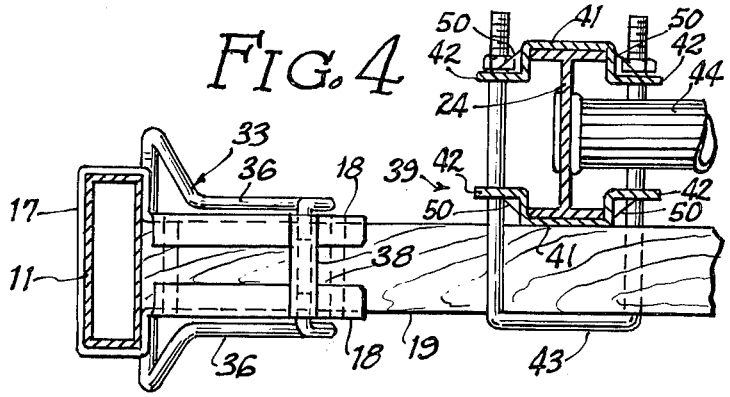
FIG. 4 is a cross-sectional view, on an enlarged scale, taken substantially on line 4—4 of FIG. 1.
Figure 5:
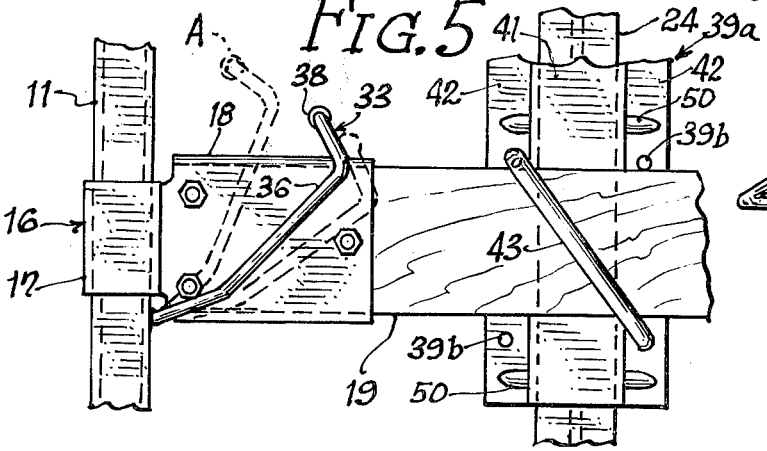
FIG. 5 is a fragmentary front elevational view of the assembly shown in FIG. 4.
Figure 3:
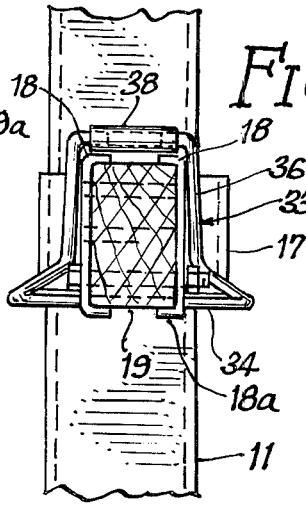
FIG. 3 is a cross-sectional view, on an enlarged scale, taken substantially on line 3—3 of FIG. 1.

Referring to FIGS. 1, 2, 4 and 5, two pairs of brackets, indicated generally by the numeral 39, are provided for mounting the cross member 19 to the side rails 24 of a ladder. Each pair of brackets 39 comprises two identical members 39*a* preferably stamped from sheet steel and each member 39*a* includes a channeled center portion 41 and outwardly directed integral flanges 42. The lower portion of each bracket member 39*a* is provided with a plurality of spaced gussets 50 stamped into the surface to strengthen and reinforce each member. As seen in FIGS. 2 and 4, two members 39*a* are arranged in confronting relation to each other and are adapted to be attached to a ladder rail 24, in the manner illustrated, and to be secured on the rail by a U-bolt 43 which embraces the transverse member 19 and passes through holes 39*b* in the pairs of members 39*a*. As seen clearly in FIG. 5, the U-bolt 43 is disposed at an angle inclined from the vertical so that one leg of the U-bolt passes through registering holes in one pair of aligned flanges 42 while the other leg passes through similar holes in the opposite pair of flanges 42.

In assembling the levelling attachment 10 to a ladder 25 the brackets 39 are applied to embrace the lowermost portions of each of the side rails 24, in the manner illustrated in FIG. 2, with the transverse member 19 in substantial registration with the lowermost rung 44. The brackets 39 are designed to spread the reaction stresses generated by the levelling attachment over a sufficient area of each rail 24 so as to prevent the rail from being over-stressed or injured by the attachment. It will be understood that the brackets 39 are applied and secured to each side rail 24 and that, when so applied, the attachment 10 may become a permanent part of the ladder 25.

In use, the attachment 10 of my invention is affixed to the rails 24 in the manner hereinabove described and illustrated. Preferably, before attaching the brackets 39 to the rails 24 the legs 11 and 12 are inserted in their respective open ended sections 17 and the same may be accomplished by rotating the latch member 33 to the broken line position indicated by the letter A in FIGS. 5 and 6. In such position the bight portion 34 is caused to be spaced a slight distance from the leg 11 or 12 so as to provide clearance for the leg 11 to move freely vertically within the socket section 17. The intermediate position of the latch member 33 is shown in the full lines in FIGS. 5 and 6 and, in such position, the outer edge of the bight portion 34 is just beginning to engage against the leg 11. As the latch lever 36 is rotated to the broken line position indicated by the letter B in FIG. 6, the bight portion 34 will be disposed substantially horizontally and the outer edge of the bight portion will be in clamping engagement with the side rail 24. It will be noted that in locking position the inner edge of the bight portion 34 is in engagement with the edges 27 of the channel ears 18. Thus, the bight portion 34 acts in the nature of a cam to impose a lateral force on a leg 11 or 12 causing the leg to cock and bind by friction against the inner surface of the socket of section 17. With the ladder 25 supported on a ground surface, preferably, with one of the legs 11 or 12 rested on the higher level of the terrain, the operator then releases the latch member 33 on the opposite side of the attachment by moving the latch member to the broken line position, as indicated by the letter A shown in FIG. 6, thereby allowing the corresponding leg 11 or 12 to slide downwardly by gravity until the foot pad 14 is in engagement with the ground surface. Thereafter, the leg is locked in position by moving the latch member 33 to the broken line position indicated by the letter B. Thus, the ladder is secured and stabilized for use on the uneven terrain.

Various changes coming within the spirit of my invention may suggest themselves to those skilled in the art; hence, I do not wish to be limited to the specific embodiments shown and described or uses mentioned, but intend the same to be merely exemplary, the scope of my invention being limited only by the appended claims.

I claim:

1. An apparatus for supporting a ladder on an irregularly contoured surface comprising, a transverse member having end portions extending outboard of the side rails of said ladder, means for securing said transverse member to said side rails, a pair of legs, each being generally rectangular in cross section, a knuckle mounted on each end of said transverse member, each knuckle including an open ended socket portion generally rectangular in cross section and shaped to slidably receive one of said legs, each knuckle including a pair of channel ears integral with a socket portion and disposed in confronting relation to each other so as to embrace one end of said transverse member, each of said channel ears extending vertically beyond at least one horizontal edge of said socket portion with the extending portion of the channel ear providing a pair of vertical abutment edges in spaced confronting relation to a respective leg, latching means associated with each knuckle, each latching means including a camming bight portion disposed between a pair of vertical abutment edges and a respective leg, said bight portion being manually rotatable to engage said abutment edges and a respective leg so as to cant said leg within said socket portion to frictionally bind said leg within said socket portion in an infinite number of adjusted positions.

2. The invention as defined in claim 1 including means for retaining said latching means in assembled relation with said knuckle.

* * * * *